US006276459B1

(12) United States Patent
Herrick et al.

(10) Patent No.: US 6,276,459 B1
(45) Date of Patent: Aug. 21, 2001

(54) COMPRESSED AIR FOAM GENERATOR

(76) Inventors: Bradford James Herrick, 5125 W. Reno, #2013, Las Vegas, NV (US) 98118; Mark D. Baxter, HC33, Box 3100, Mountain Sptrings, NV (US) 98124

( * ) Notice: Subject to any disclaimer, the term of this patent is extended or adjusted under 35 U.S.C. 154(b) by 0 days.

(21) Appl. No.: 09/495,620

(22) Filed: Feb. 1, 2000

(51) Int. Cl.[7] ..... A62C 5/02
(52) U.S. Cl. ..... 169/14; 169/71
(58) Field of Search ..... 169/13–15, 30, 169/71, 76, 85, 88, 44

(56) References Cited

U.S. PATENT DOCUMENTS

| | | | | |
|---|---|---|---|---|
| 4,291,769 | * | 9/1981 | Muller | 169/13 |
| 5,113,945 | * | 5/1992 | Cable | 169/14 X |
| 5,623,995 | * | 4/1997 | Smagac | 169/13 X |
| 5,979,563 | * | 11/1999 | Fritz | 169/13 X |
| 6,109,359 | * | 8/2000 | Ballard | 169/14 |

FOREIGN PATENT DOCUMENTS

| | | | | |
|---|---|---|---|---|
| 2031724 | * | 4/1980 | (GB) | 169/14 |

OTHER PUBLICATIONS

W.S. Darley & Co., Macaw Backpack, Catalog, Broomfield CO.

* cited by examiner

*Primary Examiner*—Lesley D. Morris
(74) *Attorney, Agent, or Firm*—Philip J. Anderson; Anderson & Morishita, L.L.C.

(57) ABSTRACT

A foam generating device includes a source of compressed gas and a source of liquid adapted to produce a foam. A gas operated pump such as a diaphragm pump is provides which has a gas inlet communicating with the compressed gas source to drive the pump, a gas exhaust, a liquid inlet and liquid discharge to discharge said liquid from the pump. An injector disposed at the discharge side of the pump and is in communication with the gas outlet of the pump to inject exhaust gas into the liquid discharged by the pump to aerate the liquid and produce a foam. The device may be portable, vehicle mounted or stationary. The liquid may be water with an injector to inject a foaming agent into the water.

13 Claims, 2 Drawing Sheets

COMPRESSED AIR FOAM GENERATOR

FIELD OF THE INVENTION

The present invention relates to devices for generating a foam product such as for fire suppression and retardation, dust control or the like.

BACKGROUND

Various fire-fighting agents have been used to fight fires. One of the more effective types of fire-fighting agents is water-based foam. This foam is composed of water and a surfactant (comprising a foam solution) and air or gas to expand the volume of the foam solution, converting the liquid solution into various consistencies of foam. Various means are utilized to aerate the foam solution. Ambient air may be aspirated into the solution at the nozzle end of a hose by an air-aspirating nozzle. This results in expansion ratios of approximately 3:1 to 5:1 over the original volume of the un-aspirated foam solution. A superior method of expanding the volume of the foam solution is to introduce compressed air into the solution prior to the solution reaching the nozzle at the end of the hose. This method usually results in expansion ratios of 10:1 to 100:1 or greater. Different expansion ratios result in different consistencies of foam, each of which is best suited to different fire-fighting environments. In addition, foam generated by compressed air foam systems is higher quality foam, with bubbles of a more uniform size, that allows the foam to last much longer. This is a substantial advantage in certain applications. For these and other reasons, foams with expansion ratios of 10:1 or greater are generally more efficient at smothering and controlling fires than foams with less than a 10:1 expansion ratio.

Heretofore, generation of compressed air foam has generally been dependent upon large, heavy, highly complicated systems composed of a water pump, an air compressor, a foam concentrate proportioner and a plethora of pipes, hoses, valves and regulatory devices. The expense of these systems has generally limited their acceptance and use to only those fire departments with large budgets and many highly trained personnel.

A portable foam generation system is disclosed in U.S. Pat. No. 5,623,995 issued Apr. 29, 1997 to Smagac. According to this disclosure, the liquid foaming solution is pumped by a gas operated pump driven by gas from a compressed gas cylinder. Compressed gas, e.g. nitrogen, from the cylinder is also injected proximate a stata tube at the discharge of the pump.

A drawback of portable foam generating systems of the type described above is that the compressed gas used to drive the pump is simply exhausted from the pump exhaust. Thus the compressed gas supply must separately supply both the pump and be injected into the liquid. It would be desirable to provide a system which would be efficient in the use of the compressed gas so that more foam could be delivered from a given quantity of compressed gas.

Still further, the stata tube described in the above patent is of a complicated construction. It would be useful to provide a device which provides for agitation and is of a simpler construction.

It is one object of the present invention to substantially simplify the process of generating foam which results in a compressed air foam generating system that is lighter, smaller, more reliable, self contained, requires less maintenance, and is less expensive and easier to operate than those that are currently available.

It is another object of the present invention to provide a foam generating device which can be produced cost-effectively in sizes that are much smaller than those currently manufactured. For that reason the subject invention will more effectively address the fire-fighting needs of smaller volunteer fire departments, industrial applications, rural and urban homeowners, vehicle owners and operators and many other applications that have not been able to afford the cost of acquisition, maintenance, or specially trained personnel that current compressed air foam systems demand.

It is another object of the present invention to reliability produce foam or other aerated product for use in fire suppression or application of a foam flame retardant or for purposes such as dust control, toxic waste clean-up, or the like.

Another purpose is to enable such fire or non-fire-related systems to be scalable in size so that applications that require smaller systems can be addressed. An additional purpose is to enable the use of compressed gasses other than air for the purpose of expanding the volume of foam or other solutions.

SUMMARY OF THE INVENTION

There is, therefore, set forth according to the present invention a foam generating device which addresses the above objects, among others, and which overcomes the drawbacks of prior systems.

Toward this end, the device includes a source of compressed gas such as, for example, a cylinder containing compressed air. A source of liquid adapted to produce a foam is also provided. The source may be a tank of liquid, expandable, foam solution, water such as the water in a swimming pool, spa or portable tank. A gas operated pump has a gas inlet communicating with the compressed gas which expands to drive the pump, a gas exhaust for the expanded gas, a liquid inlet and a liquid discharge to discharge the liquid at a positive pressure from the pump. Where water is the pumped liquid, the device includes a foaming additive and mixer to introduce the foaming additive at the pump discharge. To aerate the pumped solution for the production of, or to assist the production of foam, an injector is disposed at the discharge side of the pump. The injector in communication with the gas outlet of the pump to inject the exhausted gas into the liquid discharged by the pump. The aerated foam is thereafter delivered by piping, hose, nozzles, sprayers or the like to the area to be foamed.

To contribute to the production of foam and/or a consistent foam product, an agitator may be provided proximate the injector to further mix the aerated solution for the production of foam. The agitator may be embodied as a screen in the discharge line for the pump.

The device may be fixed, vehicle mounted or may be included as a backpack unit with the user carrying the compressed gas cylinder and a water bag or tank containing the foaming solution.

DESCRIPTION OF THE DRAWINGS

These and other features and advantages will become better understood with reference to the description, claims and drawings wherein:

DESCRIPTION

Figure 1:
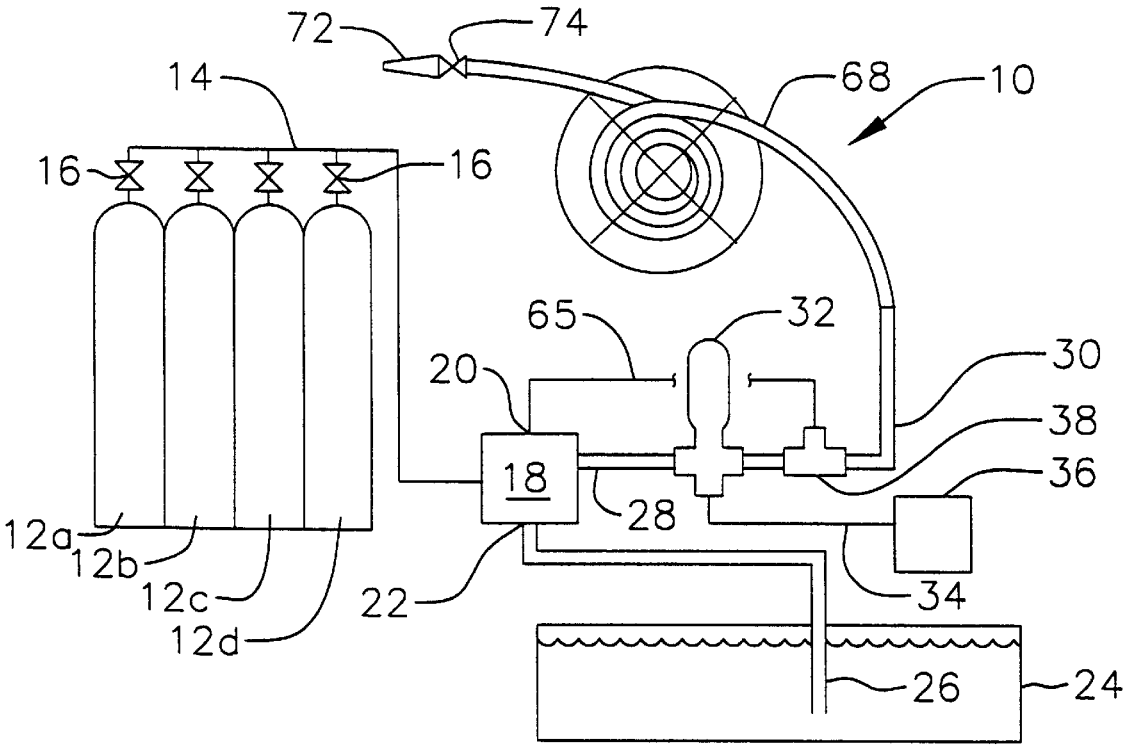
FIG. 1 illustrates one embodiment of the present invention at a fixed location.

Turning to the drawings, FIG. 1 shows one embodiment of the device 10 adapted for generating foam according to the present invention. The device 10 as illustrated is adapted for fixed applications such as out buildings, rural residences and the like.

The device 10 includes a source of compressed gas embodied as compressed air cylinders 12*a–d* each coupled to a gas header 14 through valves 16. The header 14 conducts the compressed gas from the cylinders 12*a–d*, or any one or several of them, to a gas operated pump 18, which may be a diaphragm-type pump as is known in the art. The compressed gas operates one or more diaphragms within the pump 18 for pumping of liquid thereby. The compressed gas exhausted by the pump 18 is exhausted at an exhaust 20.

The pump 18 has a suction 22 in communication with a liquid source which may be a body of water such as a swimming pool 24, spa, pond, water tank or the like. Accordingly, as shown in FIG. 1, a suction pipe 26 extends from the pool 24 to the suction 22 of the pump 18. While the suction pipe 26 is shown as a dip tube into the pool 24, it is to be understood that the suction pipe 26 could be connected to the pool circulation system to reduce the negative head on the pump 18. The pump 18 also includes a discharge 28 at which the liquid as pumped under pressure by the pump 18 is conducted for purposes of which will hereinafter become evident. Connected to the discharge 28) is a discharge line 30.

To mix a foam generating substance such as a class A foam concentrate as is known in the art, the device 10 includes a proportioner 32 which is connected through a conduit 34 to a tank or bottle 36 containing the foam generating concentrate. The proportioner 32, as is known in the art, includes pistons operated by the discharge pressure in the discharge line 30 to pump the foam generating concentrate from the bottle 36 and admit it into the discharge line 30 for mixing therewith. The proportioner 32 can be set and regulated to admit the desired concentration of the foam generating concentrate from the bottle 36.

Figure 4:
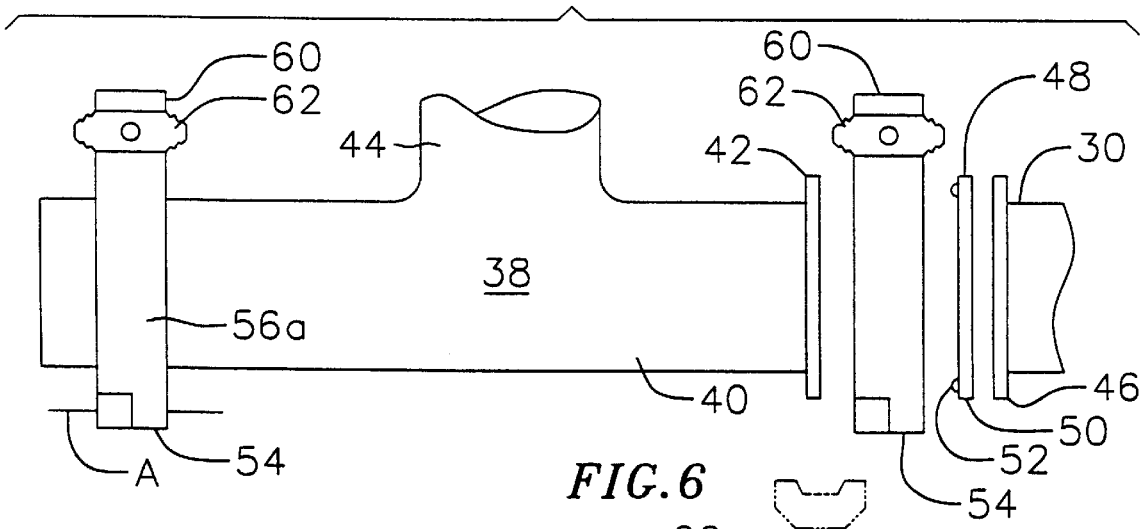
FIG. 4 is a side view of illustrates the mixer for mixing air and generating foam.
Figure 5:
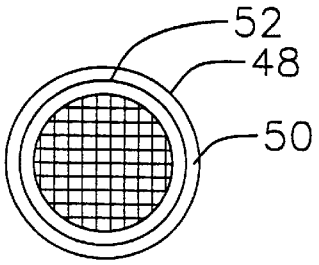
FIG. 5 is a front view of a screen for the mixer.
Figure 6:
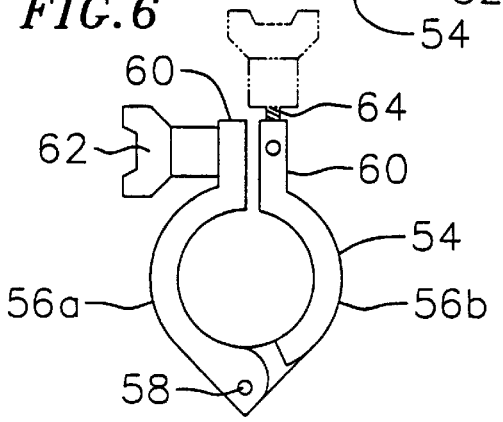
FIG. 6 is a front view of a clamp for the mixer of FIG. 4.

To mix the water from the pool 24 and a foam generating concentrate admitted at the proportioner 32, the device 10 includes a mixer 38 disposed in the discharge line 30. The mixer 38 is shown in FIGS. 4–6. The mixer 38 is adapted to agitate the liquid-foam mixer as well as to inject compressed air into the mixture for the generation of a consistent and well-defined foam product for firefighting, toxic cleanup, dust control and the like. For toxic cleanup, the foam concentrate can be a fluid of the type and quantity compatible with the desired use.

The mixer 38 has a tubular body 40 having at each end a flange 42 along the length of the body 40 a tubular T-connection 44 is provided through which air is admitted into the mixer 38 as hereinafter described. The liquid from the pump 18 is conducted through body 40 and along the discharge line 30. Connected at each end of the body 42 is the discharge line 30 and accordingly, the discharge line includes flanges 46 which meet with and adapted to abut the flanges 42 of the body 40. Disposed between the flanges 42,46 is an agitator 48 embodied as a screen mounted in a rubberized gasket 50. The gasket 50 includes a circumferential lip 52 adapted to seal against the flanges 46,42. While only one agitator 48 is shown in FIG. 4, it is to be understood that at the other end of the body 40 would be another agitator 48 of a like design.

To couple the body 40 of the mixer 38 into the discharge line 30, flange clips 54 of the type shown in FIGS. 4 and 6 are provided. The flange clips 54 are of known design and each include semi-cylindrical halves 56*a,b* joined at a pivot 58 for opening and closing the halves 56*a,b* about an axis A to release the connection between the flanges 46,42. Each of the clips 54 has a circumferential channel to retain the flanges 46,42 in an abutting and sealing relationship trapping the agitator 48 there between. Opposite the pivot 58, each clip includes upstanding clasp portions 60, one of which pivotally mounts a threaded fastener 62. In operation, the agitator 48 is disposed between the flanges 42,46 and the clip 54 is placed thereabout retaining the flanges 42,46 in the channel therein. The fastener 62 is pivoted from its phantom position shown in FIG. 6 through a slot contained in the opposite clasp 60. The fastener 62 is threaded along a threaded shank 64 to draw the clasps 60 together and thereby secure the body 40 to the discharge line 30.

To admit air into the mixer 38, the T-connection 44 may contain a like clip 54 (not shown) mounting a nipple (not shown) to the mixer 38.

Returning to FIG. 1, air from the pump exhaust 20 is conducted by a conduit 65 to the mixer 38. The fluid, pumped by the pump 18 through the proportioner 32 and mixer 38 is agitated by the agitators 48 and the air exhausted from the pump 18 is injected into the liquid to produce a foam in the discharge line 30.

To direct the foam generated by the device 10, the discharge line 30 is connected to a hose 68, a length of which may be wrapped about a hose reel 70. The hose 68 includes at one end a nozzle 72 and a manually operated on off valve 74 to turn the supply of foam to the nozzle 72 on and off.

In operation, the user would close the valve 74 and turn on the gas valve 16 at the cylinders 12*a–d*. Compressed gas operates the pump 18 to pump water through the suction pipe 26 from the pool 24 into the discharge line 30. When the valve 74 is opened and the nozzle 72 is directed to the desired area, the fluid passes through the proportioner 32 where a foam generating concentrate (or other desired chemical) is mixed into the water in the discharge line 30. At the mixer 38 the liquid/concentrate mixture is agitated by the agitator 48 and the air from the pump exhaust 20 is injected to produce a foam in the discharge line and hose which is directed from the nozzle 72 onto the desired area. As can be appreciated, by using the exhaust air from the pump 18, the compressed air of the cylinders 12*a–d* is efficiently used to first drive the pump 18 and thereafter to become injected into the liquid to produce a foam product. The injection of the air and the use of the agitators 48 has been found to produce a consistent, foam product usefully in fighting fires or applying fire retardants.

Figure 2:
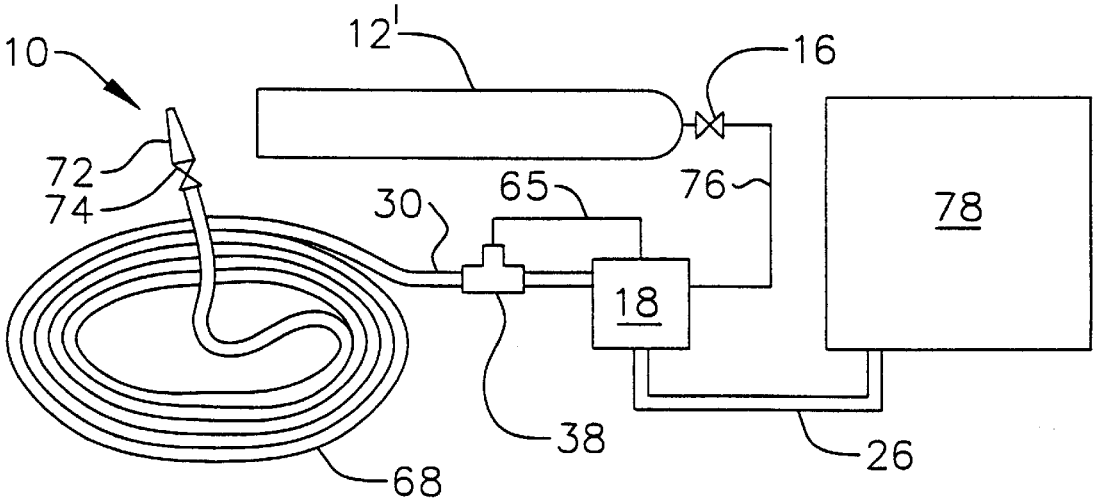
FIG. 2 illustrates another embodiment of the present invention adapted to be disposed on a vehicle.

Turning to FIG. 2, an embodiment of the device 10 adapted to be mounted to a vehicle such as a pickup truck, utility truck, van or the like is shown. According to the embodiment, the device 10 includes a cylinder 12' connected through a valve 16 and line 76 to the pump 18. The pump 18 has its suction pipe 26 connected to a tank 78 containing a premixed liquid product for generating foam. The discharge 28 of the pump 18 passes through the mixer 38 where the liquid foam product is agitated and has air injected therein through a line 65. The discharge line 30 is connected to a hose 68 having at one end a nozzle 72 and valve 74. According to this embodiment of the device, the proportioner of the previous embodiment is not required in that the liquid is a premixed product adapted for generating foam.

Figure 3:
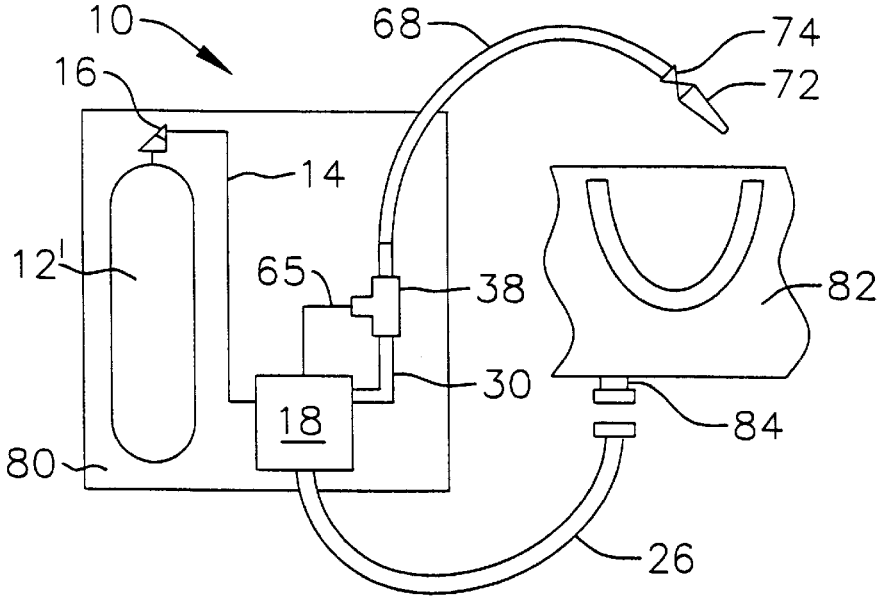
FIG. 3 illustrates and embodiment adapted to be carried as a backpack.

Turning to FIG. 3, there is shown a further embodiment of the device 10 according the present invention adapted to be carried as a backpack adapted to be carried by an individual for fighting brush fires, applying toxic cleanup materials and the like. The device 10 of FIG. 3 includes a mounting platform 80 which would include shoulder straps (not shown) or the like for carrying by the firefighter. Mounted to the platform 80 is the cylinder 12' containing compressed gas, pump 18 and the header 14 extending from valve 16 for operating the pump 18. The discharge line 30 of the pump 18 passes through a mixer 38 and is connected to a hose 68 having at its end a nozzle 72 and valve 74. Air discharged from the exhaust 20 of the pump 18 is directed to the mixer 38 by line 65 for injection into the premixed foam generating solution. To provide a supply of foam generating solution, the device 10 includes a refillable bag 82 having an outlet 84 adapted to be coupled to the suction pipe 26 for the pump 18. Thus the firefighter would manually turn on the valve 16, shown as an angle valve in FIG. 3, to operate the device 10. The bag 82 would be filled with foam generating solution which would be pumped by the pump 18 agitated and mixed with air at the mixer 38 to produce foam to be sprayed through the nozzle 72. When the bag 82 is empty, it would be refilled with foam generating concentrate.

In lieu of the bag 82, a tank or bladder may be carried by the firefighter.

The device 10, as described above, can be adjusted to produce different characteristics of foam based upon the concentrates used, the amount of air injected into the foam and the agitation provided by the agitators 48 such as by increasing or reducing the mesh of the screen.

The foam generating device 10 is adapted to produce a foam product which has greater firefighting and flame retardant properties than does water. Furthermore, the surfactants of the foam provides for wetting of a greater area with a smaller quantity of liquid pumped, and retains the surface of the material or area treated wet for a longer period of time. Further, by expanding the liquid product and generating foam, a smaller quantity of liquid can be used to generate a large quantity of foam for firefighting, toxic waste cleanup, dust control or the like.

While we have shown certain embodiments of the present invention, it is to be understood that it is subject to many modifications and changes without departing from the spirit and scope of the appended claims.

We claim:

1. A foam generating device comprising:

a source of compressed gas;

a source of liquid adapted to produce a foam;

a gas operated pump having a gas inlet communicating with the compressed gas source to drive the pump and a gas exhaust and a liquid inlet and liquid discharge to discharge said liquid from the pump;

an injector disposed at the discharge, said injector in communication with the gas outlet of the pump to inject exhaust gas into the liquid discharged by the pump to aerate the liquid and produce a foam.

2. The device of claim 1 wherein said injector is disposed in-line in a conduit coupled to the discharge, said injector including a port in communication with the exhaust and an agitator downstream of said port to agitate said liquid.

3. The device of claim 2 wherein said downstream agitator is a screen disposed to pass and agitate said fluid.

4. The device of claim 2 further including an agitator upstream of said port to agitate said fluid.

5. The device of claim 4 wherein said upstream agitator is a screen disposed to pass and agitate said fluid.

6. The device of claim 5 wherein said downstream agitator is a screen disposed to pass and agitate said fluid.

7. The device of claim 1 including a source of water coupled to the liquid inlet of the pump, a foam generating product and means for mixing the foam generating product into the water discharged from the pump to produce a foam generating liquid.

8. The device of claim 7 wherein said mixing means is a proportioner device.

9. The device of claim 8 wherein said proportioner device is in communication with the discharge of the pump and in response to the pressure of said discharge, mixes said foam generating product into the water.

10. The device of claim 1 wherein said source of liquid is a body of water, the device further including a foam generating product and means for mixing the foam generating product into the water discharged from the pump to produce a foam generating liquid.

11. The device of claim 10 wherein the body of water is a water tank.

12. The device of claim 11 wherein the water tank is a transportable water bag.

13. A foam generating device comprising:

a cylinder containing compressed gas;

a tank containing a liquid adapted to be expanded to produce a foam;

a gas operated pump having a gas inlet communicating with the cylinder to provide compressed gas to drive the pump and a gas exhaust, a liquid inlet in communication with the tank and liquid discharge to discharge said liquid at a positive pressure from the pump;

a mixer disposed at the discharge, said mixer in communication with the gas outlet of the pump to deliver exhaust gas into the liquid discharged by the pump to aerate the liquid and produce a foam.

* * * * *